US007718872B2

(12) United States Patent
Bafunno

(10) Patent No.: US 7,718,872 B2
(45) Date of Patent: May 18, 2010

(54) REPETITION ACTION MECHANISM FOR AN UPRIGHT PIANO

(76) Inventor: Pasquale Bafunno, Via Aie, 183, Oppeano, Verona (IT) 37050

( * ) Notice: Subject to any disclaimer, the term of this patent is extended or adjusted under 35 U.S.C. 154(b) by 579 days.

(21) Appl. No.: 11/662,534

(22) PCT Filed: Sep. 14, 2005

(86) PCT No.: PCT/IT2005/000524

§ 371 (c)(1),
(2), (4) Date: Mar. 9, 2007

(87) PCT Pub. No.: WO2006/030474

PCT Pub. Date: Mar. 23, 2006

(65) Prior Publication Data

US 2009/0114074 A1 May 7, 2009

(30) Foreign Application Priority Data

Sep. 14, 2004 (IT) ..... MI2004A1750

(51) Int. Cl.
*G10C 3/18* (2006.01)

(52) U.S. Cl. ..... 84/240; 84/253

(58) Field of Classification Search ..... 84/240, 84/241, 242, 253
See application file for complete search history.

(56) References Cited

U.S. PATENT DOCUMENTS 2,116,117 A 5/1938 Homm
3,100,416 A * 8/1963 Roehrig ..... 84/240
4,854,211 A * 8/1989 Tanaka et al. ..... 84/240
4,879,939 A 11/1989 Wall et al.

FOREIGN PATENT DOCUMENTS

GB 123 195 A 2/1919

OTHER PUBLICATIONS

International Search Report, Dec. 23, 2005.

* cited by examiner

*Primary Examiner*—Jianchun Qin
(74) *Attorney, Agent, or Firm*—Hedman & Costigan, P.C.; James V. Costigan

(57) ABSTRACT

An improved device for providing the magic touch effect during a double repetition in an upright piano wherein the device comprises a plurality of keys swingably mounted on a keyboard frame and supporting a suitably inclined slanted drive element, which can be screw adjusted and is inter-coupled to a slanted swinging arm that operates as a control lever that is pivoted to an abruptly clockwise downstream slanted main bridge having an escapement lever coupled to a butt roller of a hammer, pivoted to a first pillar element, that supports adjusting buttons for adjusting a first and second escapements. The main bridge assembly is coupled to a second pillar element, that is pivoted to the lever of the second escapement.

2 Claims, 4 Drawing Sheets

REPETITION ACTION MECHANISM FOR AN UPRIGHT PIANO

BACKGROUND OF THE INVENTION

The invention relates to an improved mechanism for achieving the so-called magic touch effect during double repetition in an upright piano.

As is well known, upright pianos are not suitable to musically reproduce the so-called magic touch which, in actual practice, requires to provide a high level of energy as required to compact the harmonics of in the sounds produced by the piano strings when they are transitorily struck.

Prior approaches to achieve the above mentioned compactness have not been found as satisfactory, since they are very complex from a mechanic standpoint and unsuitable to produce the required harmonic characteristics.

SUMMARY OF THE INVENTION

Accordingly, the aim of the present invention is to overcome the above mentioned problem, by providing a device adapted to achieve the double-repetition magic touch effect in an upright piano, which is structurally very simple, and comprises a very small number, of component elements of simple and reliable configuration and construction.

Within the scope of the above mentioned aim, a main object of the present invention is to provide such a device which is mechanically very efficient and which, moreover, being specifically designed for upright pianos, is adapted to allow an easy adjustment of its two escapements, without generating large-size or interference problems.

Another object of the present invention is to provide such a device which, owing to its peculiar constructional features, is very reliable and safe in operation.

Yet another object of the present invention is to provide such a device which is very competitive from a mere economic standpoint.

According to one aspect of the present invention, the above mentioned aim and objects, as well as yet other objects, which will become more apparent hereinafter, are achieved by an improved device specifically designed for providing the so-called magic touch effect during a double repetition in an upright piano, characterized in that said device comprises a plurality of keys, said keys being swingably mounted on a keyboard frame and supporting, each, a drive element interconnected with a slanted swinging arm, in turn pivoted to a main swinging bridge assembly, said main swinging bridge assembly being operatively coupled to a hammer butt roller pivoted to a first pillar element and supporting a plurality of adjusting buttons for adjusting a first and second escapements, a second pillar element being coupled to said main swinging bridge assembly, to said second pillar element being pivoted a lever of said second escapement supporting an adjusting button element for adjusting the operating angle thereof, said adjusting button element cooperating with a lever of said first escapement supporting a further adjusting button element.

BRIEF DESCRIPTION OF THE DRAWINGS

Further characteristics and advantages of the present invention will become more apparent hereinafter from the following detailed disclosures of a preferred, though not exclusive, embodiment of the invention, which is illustrated, by way of an indicative, but not limitative example, in the accompanying drawings, where.

DESCRIPTION OF THE PREFERRED EMBODIMENTS

Figure 1:
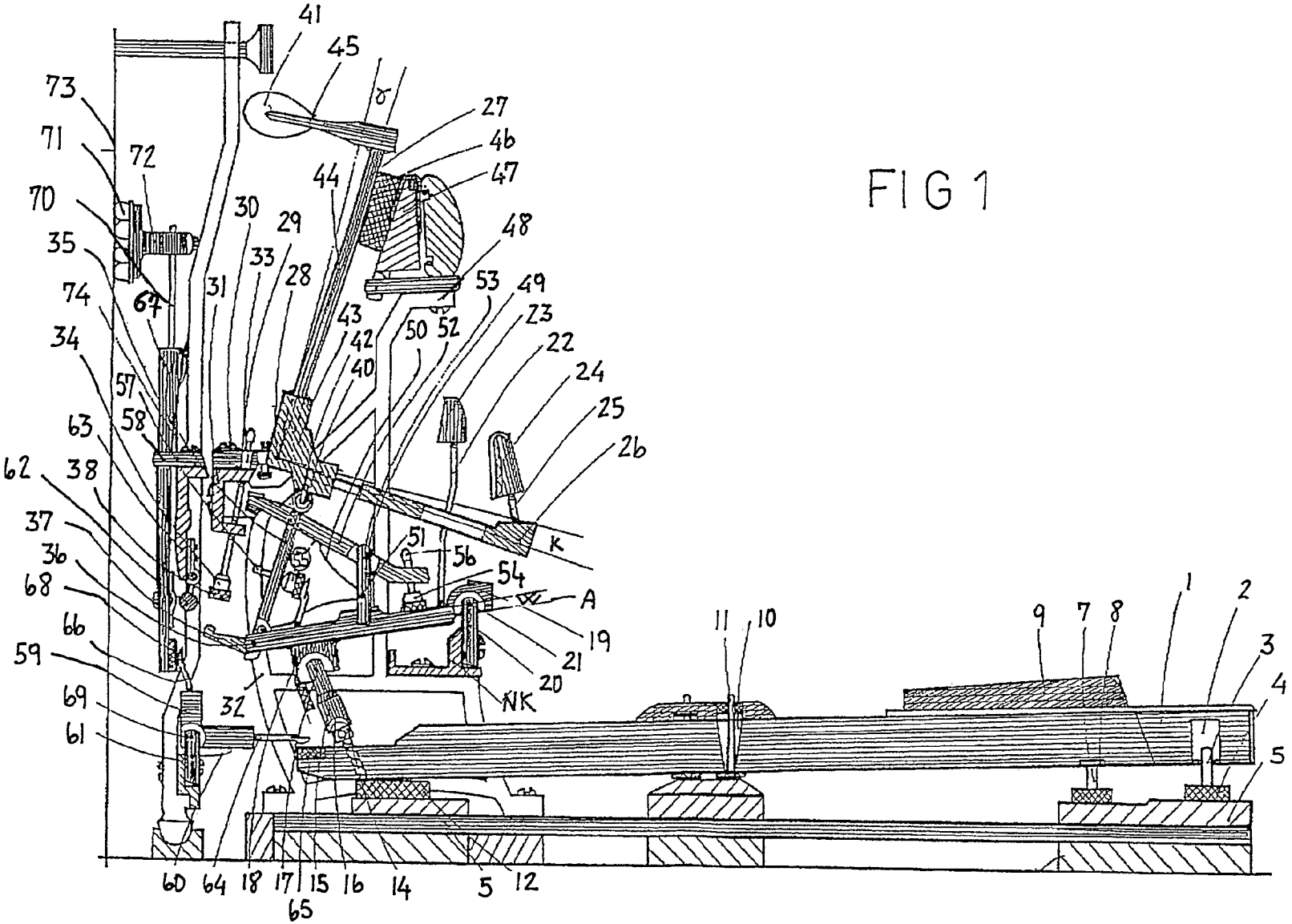
FIG. 1 schematically shows the operating mechanism according to the present invention, in a rest position thereof, with the rod damping device and frame in a separated condition.

With reference to the number references of the above mentioned figures, the improved device, specifically designed to provide the so-called magic touch effect during a double repetition in an upright piano, according to the present invention, comprises a plurality of keys 1 which, at a free end portion thereof, comprise a slot operating as a key guiding element, owing to the engagement thereof with an oval tip 3; as shown, at the bottom of said oval tip 3 a pad element 4 for damping or cushioning the key 1 depression stroke is provided.

The oval tip 3 and pad element 4 are coupled to the keyboard frame 5, which also supports a further pad element 6, associated with a second oval tip 7, said further pad element engaging in a guide slot 8 and being arranged on a black key 9 of the keyboard.

Said keys 1 and 9 are pivoted, through a guide slot 10, to a fixed round tip 11, operating as a pivot pin or fulcrum for allowing the keys to swing, said fixed round tip 11 also projecting from said keyboard frame 5.

As shown, the keys 1 are further cushioned, at a rest condition thereof, by a further pad element 12, also applied to the keyboard frame 5.

The key 1, at its opposite end portion, supports a metal drive element 14, suitably anti-clockwise slanted, which can be screw adjusted, and having, at the top thereof, a cylindric configuration with an ogival end portion to transmit driving power to a slanted swinging arm 15.

The latter practically provides a knee-joint lever, which can be considered as a continuous energy or power escapement lever, the angle of which varies to control acceleration and deceleration of key depression.

Said lever is provided, at the bottom thereof, with a concave contour, housing therein a small cushioning pad or felt 16, operating to cushion the drive element 14 engagement.

The mentioned slanted swinging arm 15, in turn, is pivoted, through a pivot pin 17, to a first pillar element 18, supporting a further bearing pad or felt for bearing thereon the slanted swinging arm 15.

The pillar element 18 is rigidly coupled, for example by glue, to a main swinging bridge assembly 19, which can swing with respect to a fork element 20, on a horizontal pivot pin 21, rigid with the rod NK coupled, by a screw, to the framework of the device.

The main bridge assembly 19 defines an angle W having a different ratio between the axis (A) of the bridge assembly 19 and the axis joining the two pivot pins 21 and 36.

Said main bridge assembly supports moreover a metal rod 22 which, at the top free end portion thereof comprises a first hammer abutment or catcher 23, cooperating with a second hammer abutment or catcher 24, which is applied, through a metal rod 25, to the catcher shank 26 of a hammer assembly, generally indicated by the reference number 27.

The butt element of the hammer 27 is pivoted on a pivot pin 28 which is coupled to a second pillar element 29, which is coupled, through a coupling screw 30, to the metal frame 31 in turn coupled to the framework of the mechanism 32.

Through said second pillar element 29, a throughgoing opening 33 is provided, in which is engaged the metal rod supporting, at its bottom end portion, a first adjusting button 34, for adjusting the first escapement, the lever 35 of which is pivoted through a pivot pin 36 to said main bridge element 19.

Said lever 35 is provided, in turn, with a tail portion 37, adapted to abut against a cushioning pad or felt 38, coupled to the button 34 of the first escapement.

Figure 2:
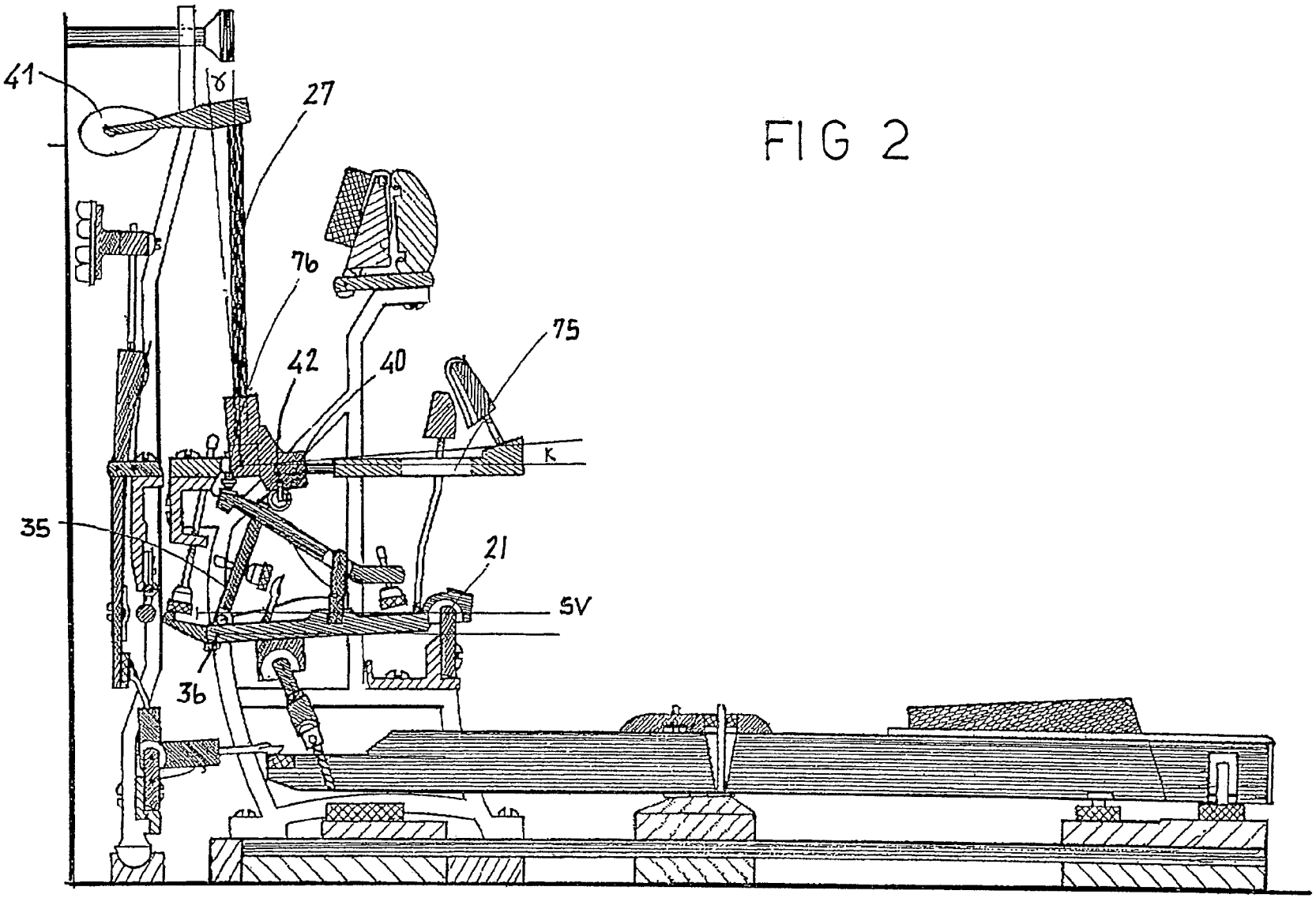
FIG. 2 schematically shows the device with a key thereof in a driven or operated condition.

With reference to FIG. 2, as the key, in its rotary movement, transmits power or energy, the lever or jack 35 is caused to disengage from a roller 40 driving a hammer felt 41, thereby ending its anti-clockwise stroke, whereas the pin 36 does not reach a horizontal line in alignment with the pivot pin of the bridge assembly 19, and will remain at large distance above the level of the horizontal line of the pivot pin 21.

As shown, the roller 40 is linked to the connecting butt 27, through a coupling pin 42 of the hammer 27, at its butt point 43.

In particular, said hammer butt point 43 supports the rod 44 of the hammer felt 41 which, in turn, is supported the hammer molding 45.

The hammer rod, or shank 44, after having struck and rebounded off the piano strings, can perform a swinging movement and, at an end of stroke or limit portion thereof is braked by a braking felt or pad 46 which is applied to a hammer bearing bar 47, fixed to the point 48 of the framework.

It should be pointed out that the device further comprises a second pillar element 49, arranged at a middle portion of the main bridge assembly 19 and including a V-shape spring 50 which is connected at an attachment point 51, provided on the pillar element 49 and having the end portions thereof affecting the lever 52 of the second escapement and the lever 35 of the first escapement.

More specifically, the lever 52 of the second escapement is pivoted to the pillar element 49 through a pivot pin 53 which also horizontally extends.

The spring 50 clockwise urges the levers 35 and 52 respectively, of the first and second escapements.

Said levers 35 and 52 comprises button elements 54 and 55 which are supported by adjusting screws 56 and 57.

The device according to the in invention comprises moreover a swinging movement cushioning element, indicated by the reference number 58, comprising a crank lever 59, pivoted on a pivot pin 69, and being applied to a bar or rod 61.

The pedal 62 of the cushioning or damping elements is coupled to the metal body 63 of the damping or cushioning lever 67.

Said lever 59 comprises, at an end portion thereof, a metal spoon element 64 cooperating with an end portion of the key 1 and abutting on a pad or felt 65 supported by said key.

The lever 59 is constantly urged in abutment on the felt or pad 68 of the spring 60.

A second spoon element 66 cooperates with the bottom end portion of a damping lever 67, including a cushioning felt or pad 68 and being adapted to swing about a swinging pin 58.

The damping lever 67 supports, at its other end portion, a metal arm 70 bearing a felt or pad 71, through a support element 72, urged by the urging spring 74 against the piano string 73 providing the harmonic sound.

Thus, the component elements of the inventive device will cooperate to apply a constant percussion intensity on the piano strings, regardless of the dynamic pressure applied on the key 1, even if several rapid key pressures are made consecutively.

The slanted swinging arm 15 is so designed and arranged as to provide, with the lever 35, a suitable angle adapted to provide the subject mechanism with a high mechanical efficiency, to the benefit of the hammer mechanism 27.

Figure 3:
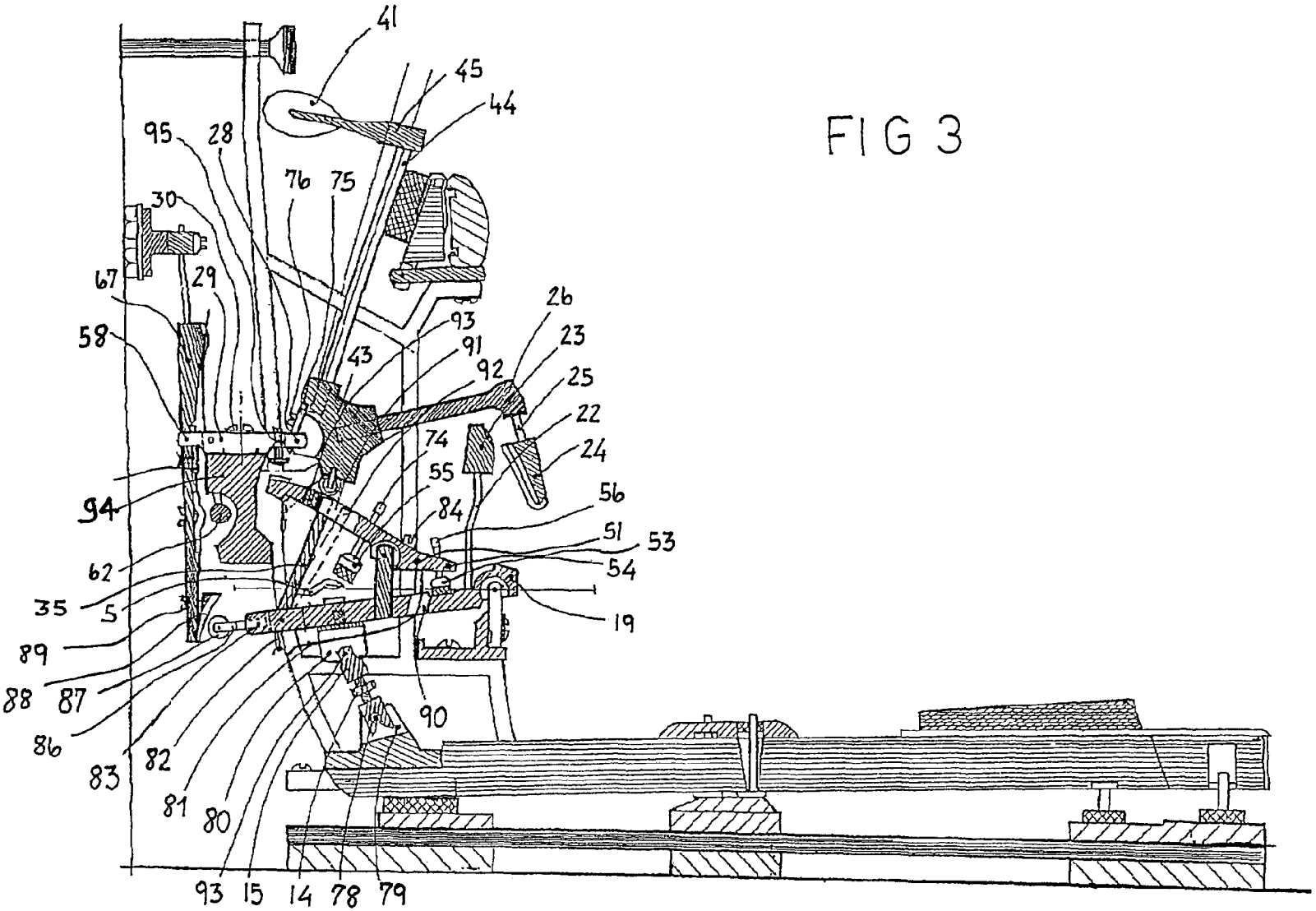
FIG. 3 is a view similar to the preceding figures, but illustrating the inventive device in a further simplified embodiment thereof.
Figure 4:
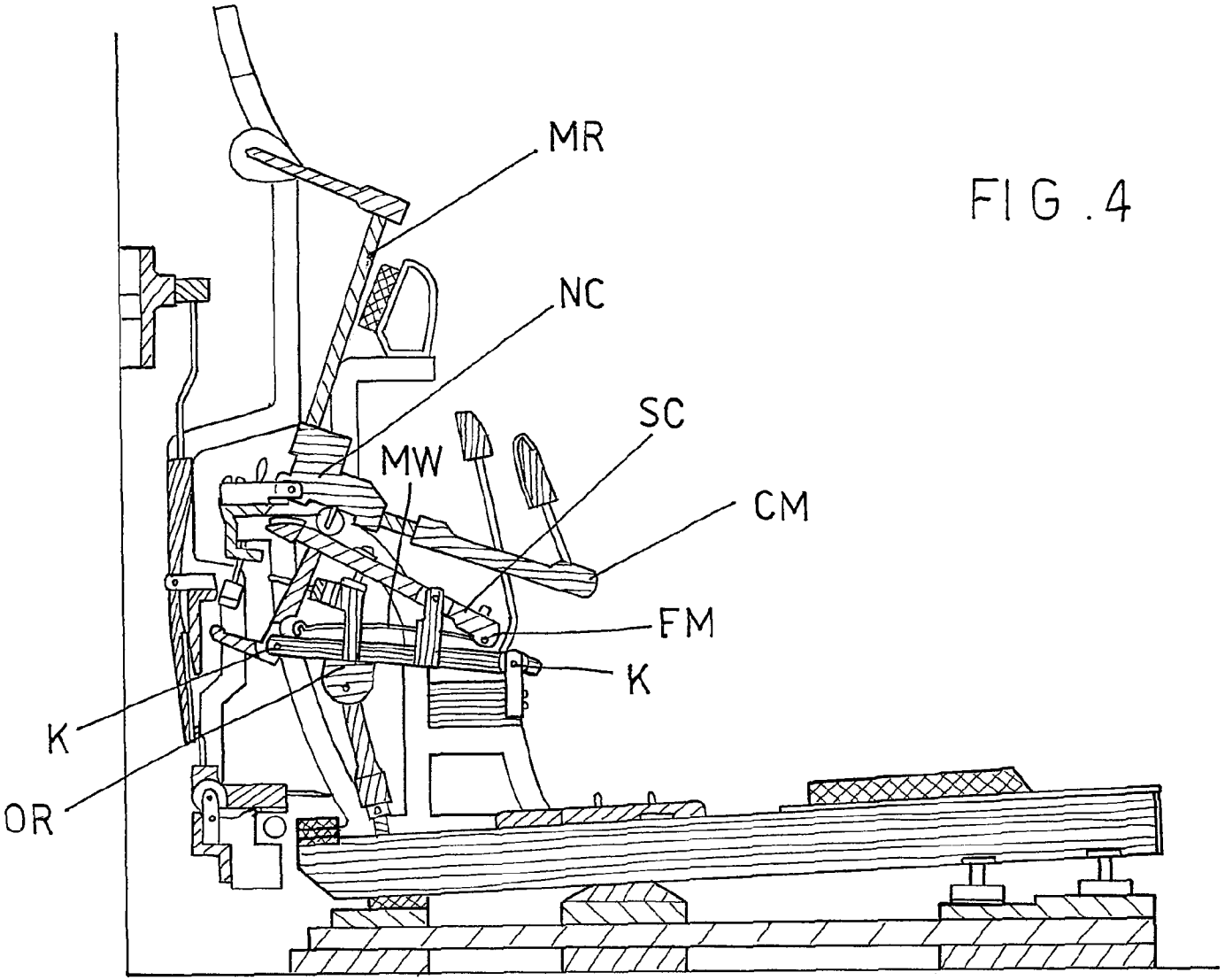
FIG. 4 is a further version of the device.

FIG. 3 shows a modified embodiment of the device which has been further simplified, mainly with respect to the bar or rod 94 supporting the double fork pillar element 29, to allow the hammer 44 rigid with the coupling butt pivoted on the pivot pin 28 of the pillar element 29 to swing; this clamping mechanism being formed by the plate 75 clamped to the butt element 43 by the clamping screw 76.

The hammer butt supports, at a side end portion thereof, and by glue, the tail portion of the hammer 26 which is suitably upward clockwise slanted, and comprises a hammer catcher 24, having its bottom end portion downward extending and rigid with the tail portion 26 through a metal arm 25.

The damping device 67, pivoted to the pivot pin 58 of the pillar element 29 is driven, during the movement, by a sliding wheel 87 pivoted to the pivot pin of the metal fork 86 which, in the movement portion, operates on a wedge element 88 fixed to the bottom end portion of the damper 67, which can be adjusted by the adjusting screw 89.

When energy is transmitted by depressing the key, the slanted swinging arm 15, by urging the main bridge assembly 19, affects, through the lever, the first escapement 35 and second escapement 53 below the roller of the hammer butt 43.

The operating stroke of the lever of the second escapement is locked by a small button element 95 coupled to the pillar element 29, thereby providing a downward directed angular movement which, by operating on the spoon element 85, disengages the lever 35 of the first escapement in a clockwise direction, thereby allowing the hammer 44 to back rebound, after having struck the piano strings, and thus impacting the catcher 24 cooperating with the catcher 25, as it has been broadly disclosed with reference to FIGS. 1 and 2.

The slanted swinging arm 15, at a middle portion thereof, comprises an adjusting metal screw, the top end portion thereof is engaged in the portion pivoted with the pivot pin 93, which screw, as it is anticlockwise turned, will transmit an upward directed urging force.

At its bottom end portion engaged in the portion pivoted to the pivot pin 78, said screw, in its anticlockwise movement, will transmit its force downward, thereby causing a quick expansion of the parts in the opposite direction.

The pillar element 80, rigid with the bridge assembly 19, comprises a wide slot for allowing the spring 81 pivoted to the pivot pin 51 of the lever 54 of the second escapement to pass therethrough.

Thus, the spring will urge the lever 35 of the first escapement in an anticlockwise direction, thereby abutting against the felt or pad element 93, which is suitably engaged in the slot 91 of the lever of the second escapement, which is clockwise urged and locked by the adjusting button 53.

The bridge assembly 19 comprises, at a middle portion thereof, a slot 90 for allowing the spring 81 to pass therethrough in the underlying part of the bridge assembly so as to provide an increase elasticity in the movement of the lever of the first and second escapements.

The screw 84 operates as an adjustment screw for adjusting the force of the spring 81.

The lever 35 of the first escapement supports, at its bottom end portion, a spoon element 85, cooperating with the button 55 clamped near the pivot point of the lever 51 of the second escapement.

As the button 55 is lowered or depressed it affects said lever 51, and causes the lever 35 to clockwise disengage, thereby allowing the hammer 44 to freely transmit its energy against the piano string.

From the above disclosure, it should be apparent that the invention fully achieves the intended aim and objects.

In particular, it is to be pointed out that the specifically designed inventive constructional features allow to provide a very simplified device, together with a great operating reliability.

The invention, as disclosed, is susceptible to several modifications and variations, all of which will come within the scope of the invention.

For example, it would be possible to design an embodiment of the device adapted to also operate above the horizontal line, in an upward direction.

Moreover, all the constructional details can be replaced by other technically equivalent elements.

Furthermore, it would be also possible to design a further modified embodiment of the device, adapted to operate with a movable fulcrum arrangement including springs of the well-known HERARD system.

In practicing the invention, the used materials, as well as the contingent size and shape, can be any, according to requirements and the status of the art.

The invention claimed is:

1. An improved device for providing the magic touch effect during a double repetition in an upright piano including a plurality of piano strings, said device comprising a plurality of keys, swingably mounted on a keyboard frame, each said key supporting, an anticlockwise inclined adjustable substantially cylindrical drive element, coupled to a slanted swinging arm operating as a first escapement lever, pivoted to a main swinging bridge assembly which operatively swings with said first escapement lever coupled to a butt roller of a hammer pivoted to a first pillar element, said main swinging bridge assembly being anticlockwise downward inclined with respect to a horizontal line, said first pillar element supporting a plurality of adjusting buttons for adjusting a first and second escapement, a second pillar element coupled to said main swinging bridge assembly, a second escapement lever pivoted to said second pillar element, said second escapement lever supporting an adjusting button for adjusting an operating angle of said second escapement lever also supporting an adjusting button, said drive element comprising screw adjusting means and an ogival end portion engageable in a concave contour seat defined at a bottom end portion of said swinging arm, said main swinging bridge assembly supporting a first hammer checker not affected by said second escapement lever, said second escapement lever having a S-shape configuration and cooperating with a second hammer checker clamped to a tail portion of said hammer, each said key having a side slot for housing a black key and comprising a round tip housed in a guide slot, said first escapement lever being substantially upward elongated and having an angled tail portion abutting on a felt element applied to a button of said first escapement, said device further comprises a further felt element, applied to a hammer bearing bar, adapted to operate as an end of stroke element for a hammer rod, said second pillar element pivotably supporting a V-shape spring operating between said first escapement lever and said second escapement lever, said, device also comprising a damping assembly for damping a sound of a said piano string, said damping assembly comprising a crank lever to end portions of which are respectively coupled a first and second metal spoon elements cooperating with an end portion of the key and a bottom portion of a swinging damping lever, said damping lever supporting an end felt element operating on a piano string, wherein each said hammer has a coupling hammer butt supporting, at a side end portion thereof and by gluing, a hammer tail portion, upward clockwise slanted, which comprises the hammer catcher with its bottom end portion downward directed and rigid with said tail portion by a metal arm, said damping device being pivoted to the pin of the pillar element being driven during the movement of a sliding wheel pivoted to a pivot pin of a metal fork which, in its movement portion, operates on a wedge element clamped to the bottom end portion of the damping assembly which can be screw adjusted; as the key imparts its energy, said slanted swinging arm, urging said main bridge assembly, operating, through said first escapement lever and second escapement lever, below the hammer butt roller.

2. The improved device according to claim 1, wherein said second escapement lever, during the operating stroke thereof, is locked by said pillar button, thereby providing an angular movement which, by operating on the spoon, causes said first escapement lever to be lowered, thereby allowing said hammer to back rebound, after having struck a piano string, to fixedly engage with said first hammer catcher cooperating with said second hammer catcher, said swinging arm comprising, at an intermediate portion thereof, an adjusting metal screw which has a top end portion engaged in a pivoted portion thereof, said screw, during its anticlockwise turning movement, providing an upward directed force, whereas, at a bottom end portion of said screw, engaged in said pivoted portion, said screw operating in an anticlockwise direction and transmitting a downward directed force, thereby causing an opposite direction quick expansion movement of the parts.

* * * * *